US005475990A

United States Patent [19]

Schmid et al.

[11] Patent Number: 5,475,990

[45] Date of Patent: Dec. 19, 1995

[54] SINKER CONTROL ACTUATOR FOR FLAT KNITTING MACHINE

[75] Inventors: Franz Schmid, Bodelshausen; Reiner Haas, Metzingen, both of Germany

[73] Assignee: S. Stoll GmbH & Co., Reutlingen, Germany

[21] Appl. No.: 331,346

[22] Filed: Oct. 27, 1994

[30] Foreign Application Priority Data

Nov. 5, 1993 [DE] Germany ..... 43 37 776.9

[51] Int. Cl.[6] ..... D04B 15/36

[52] U.S. Cl. ..... 66/78; 66/60 R; 66/106

[58] Field of Search ..... 66/60 R, 64, 78, 66/104, 106, 108 R, 109

[56] References Cited

U.S. PATENT DOCUMENTS 2,909,049 10/1959 Rees ..... 66/106 X 4,713,948 12/1987 Schmidt et al. .

FOREIGN PATENT DOCUMENTS

| | | | |
|---|---|---|---|
| 145813 | 6/1901 | Germany | 66/78 |
| 2061502 | 71/1971 | Germany . | |
| 3609539 | 12/1987 | Germany . | |
| 3917934 | 12/1989 | Germany . | |
| 4278 | 11/1892 | Sweden | 66/78 |
| 465117 | 12/1968 | Switzerland | 66/78 |

*Primary Examiner*—John J. Calvert
*Attorney, Agent, or Firm*—Michael J. Striker

[57] ABSTRACT

In a two-bed flat knitting machine separate sinker control devices are provided for controlling sinkers arranged between needles and have a device body laterally releasably mountable on a machine carriage. They extend only over an operating region of a cam system and their control parts are formed so that they are displaced during a carriage stroke return automatically to an operative position or a rest position.

8 Claims, 3 Drawing Sheets

SINKER CONTROL ACTUATOR FOR FLAT KNITTING MACHINE

BACKGROUND OF THE INVENTION

The present invention relates to a two-bed flat knitting machine with needles, longitudinally displaceably bearing needle beds and sinkers pivotally arranged between the needles and actuatable by a machine carriage with a projection which is reciprocatingly movable in a comb gap between the needle beds.

Flat knitting machines of the above mentioned general type are known in the art. One of such machines is disclosed for example in the patent document DE 36 09 539 C. For controlling the sinkers, special cam regions on the carriage are provided. They require a complicated construction of the machine carriage as disclosed, for example in the document DE 39 17 934 A, and corresponding space consumption in the cam region of the carriage.

SUMMARY OF THE INVENTION

Accordingly, it is an object of the present invention to provide a flat knitting machine with needles and sinkers of the above mentioned general type, which avoids the disadvantages of the prior art.

More particularly, it is also an object of the present invention to provide a flat knitting machine in which the control of the sinkers is performed in a maximum simple and space economical manner while avoiding a complicated construction of the cam region of the carriage.

In keeping with these objects and with others which will become apparent hereinafter, one feature of the present invention resides, briefly stated, in a two-bed flat knitting machine in which the control of the sinkers is performed by separate devices mountable releasably laterally on the machine carriages and which have a length which does not exceed the effective length of a cam system. The control parts for control feet have the sinkers, and selectively one of them is associatable with each cam system of the machine carriage.

When the two-bed flat knitting machine is designed in accordance with the present invention, it is not necessary to provide a special sinker control region with sinker guiding paths extending over the whole length of the machine carriage. The device is provided with control parts for the sinkers for lateral releasable mounting on the machine carriage which are arranged in multi-system machine carriages only at those cam system which have to be used with a selected knitting program. The needle control region of the machine carriage can be designed compactly through the laterally arranged control devices for the sinker which also contributes to a weight-saving construction of the machine carriage;

The sinker control devices can be designed simply and automatically controllable. The guide paths for the control feet of the sinkers can be limited on the one hand by two cam webs which follow one another in a throughgoing direction and are coupled with one another for performing opposite adjusting movements directed perpendicular to the throughgoing direction. On the one hand it can be limited by two guide plates which are spring-loaded at one side and also move perpendicular to the throughgoing direction. The opposite adjusting movement of both control webs can be obtained structurally in a simple manner in that both control webs are articulated through a double link so as to be parallelly displaceable on the device body and coupled with one another by a further link, so that due to the additional coupling link during an adjusting movement of each preceding cam web the subsequent cam web is forced in the opposite adjusting direction. The spring loaded guiding plates which limit the control web of the control feet of the sinkers at the other side are forcedly turned by the running-on control feet for releasing the control paths. The friction forces applied to the adjustable control parts of the sinker control devices or the friction forces applied from the needle beds on the cam webs are sufficient during a carriage stroke reverse for automatic release of the opposite converting movement of the cam webs. Additional adjusting parts for providing a positive adjustment of the cam webs and the guiding plates can be dispensed with.

Advantageously, the maximum adjustment of the control webs and thereby the adjustment of the maximum turning movement of the sinkers is performed by adjusting eccentrics.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
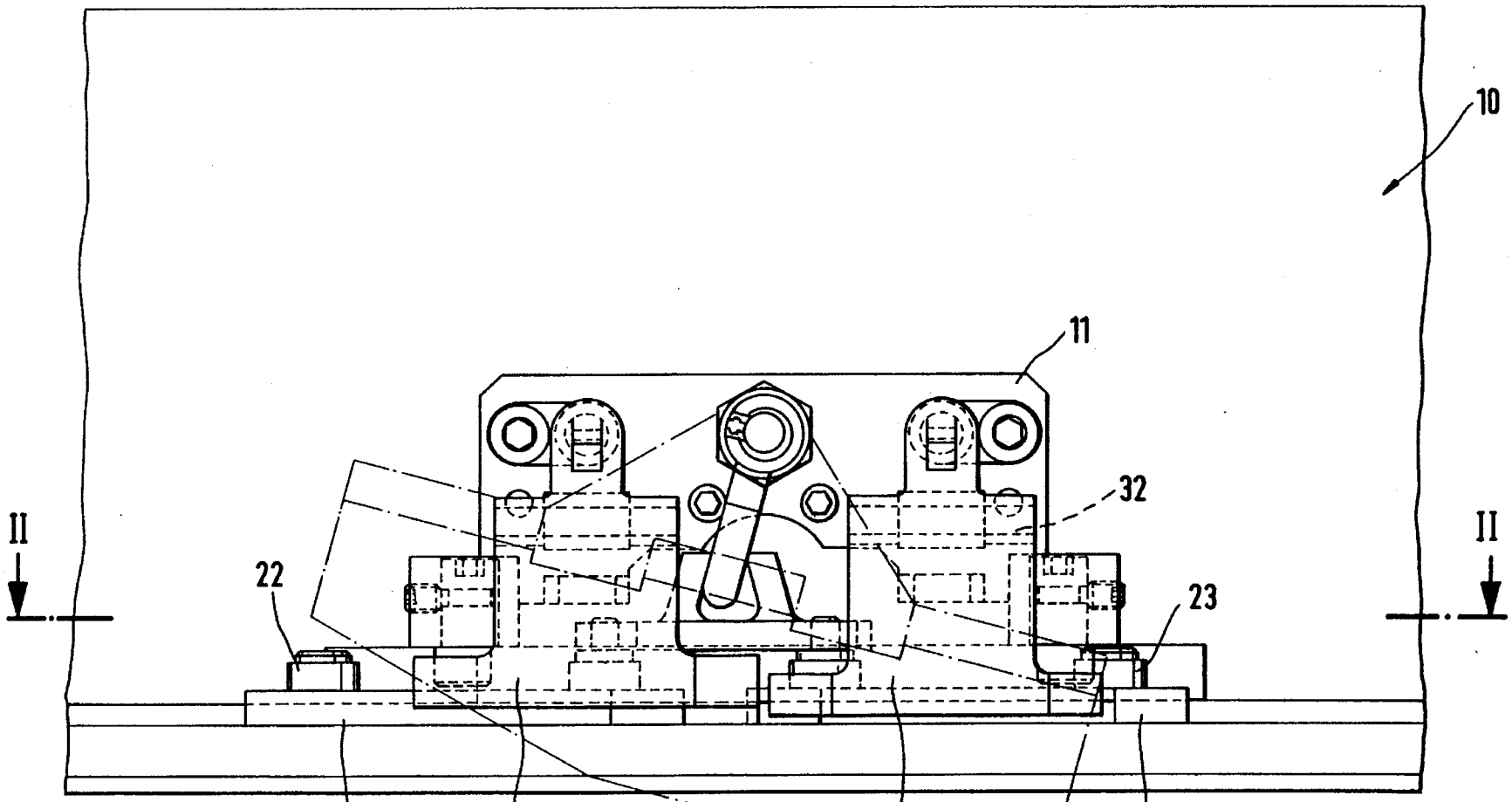
FIG. 1 is a side view of a sinker control device provided for a cam system of a machine carriage of a flat knitting machine in accordance with the present invention.

A sinker control device 10 shown in the drawings is composed of a plate-shaped device body 11 which can be laterally releasably mounted before each cam system on a machine carriage of a two-bed flat knitting machine. The sinker control device 10 extends correspondingly only over the efficient length of one cam system S of the machine carriage as identified in FIG. 2 with broken lines. Both needle beds 12 and 13 of a V-bed flat knitting machine can be seen from the schematic showing of FIG. 3. The both machine carriage parts 14/1 and 14/2 which are correspondingly arranged on both needle beds for needle control are not shown in detail. FIG. 3 shows the central plane 15 which extends through the comb gap of the flat knitting machine, as identified with a dash-dot line. A needle slider 16 with an associated needle 17 is shown in one needle bed 13 in an extended position, together with an adjacent sinker 19 pivotally supported about a bar 18. The sinker 19 which is to be controlled with the device 10 has a projection 19.1 turnable pivotable into the comb gap and a control foot 19.2.

Figure 2:
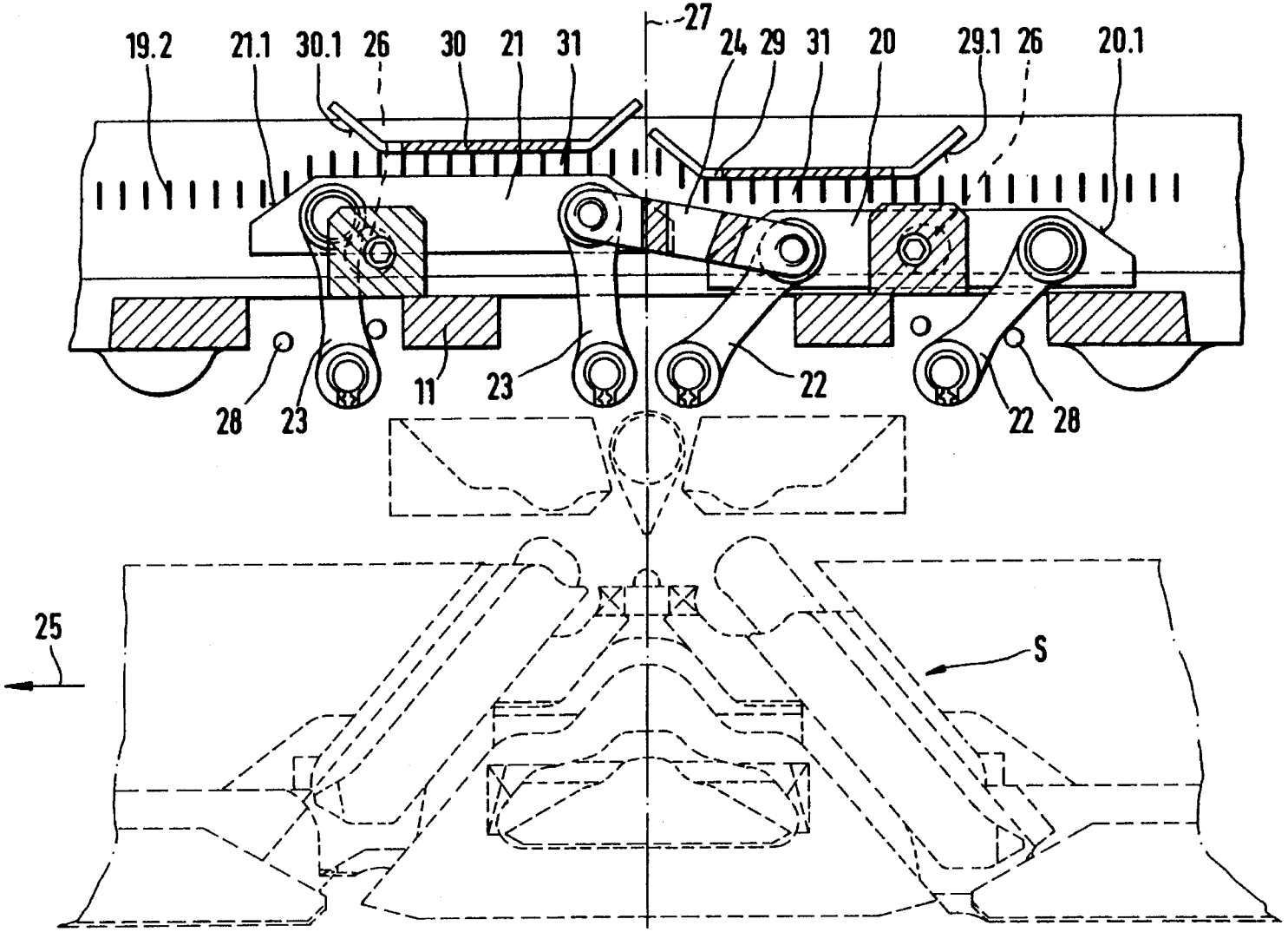
FIG. 2 is a view showing a partial section through the sinker control device taken along the line II—II in FIG. 1 with a view of the device parts for the sinker control.
Figure 3:
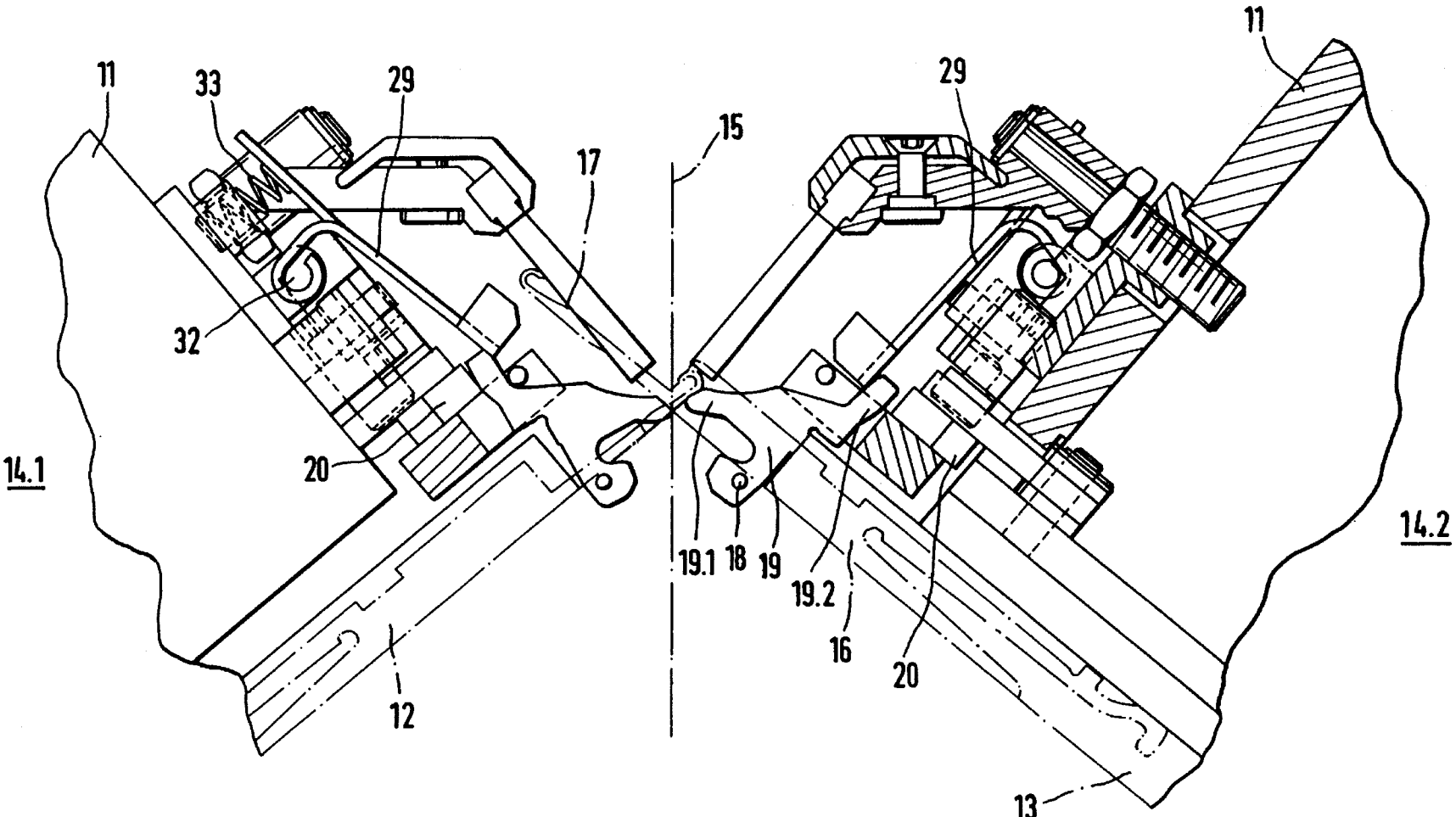
FIG. 3 is a view showing a partial cross-section through a machine carriage provided with laterally mounted sinker control devices, transversely to the longitudinal direction of the needle beds.

For controlling the sinkers 19, elements of the sinker control device 10 provided on their control foot 19.2 are shown clearly in FIGS. 2 and 3. Two cam webs 20 and 21 are arranged one behind the other in the displacement direction of the machine carriage. They are provided at their ends correspondingly with inclines 20.1 or 21.1 for the control feet 19.2 of the sinkers 19. Both cam webs 20-and 21 are supported in a parallel adjustable manner by two parallel links 22 or 23 on the device body in direction transverse to the carriage throughgoing direction. Moreover, both cam webs 20 and 21 are articulately coupled with one another by an additional link 24. The cam web 21 which is leading in the carriage stroke direction shown in FIG. 2 by an arrow 25 is lifted from the device body 11 by the control foot 19.2 of the sinker 19 which runs onto the incline 21.1 in FIG. 2, and for example by the friction forces applied by the needle beds 12 or 13 on the cam web 20. Due to the opposite coupling by the link 24, this forcedly leads to a return of the subsequent cam web 20 against the device body 11. The cam web 21 is provided with an adjusting eccentric 26 which can adjust a maximum transverse displacement path in direction of the arrow 27 of the cam web 21. Moreover, the turning of the parallel links 22 and 23 of both cam webs 20 and 21 is limited by an abutment 28 mounted on the device body 11.

Both cam webs 20 and 21 are associated with guiding plates 29 or 30 having correspondingly an inclined edge running surface 29.1 and 30.1. The cam webs 20, 21 limit their associated guiding plates 29 and 30 the guiding path 31 for the sinker foot 19.2 formed by the device 10. The guiding plates are turnably supported about an axis 32 which is directed in the carriage movement direction in FIG. 3 and therefore parallel to the device body 11. They are pretensioned by a pressure spring 33 in direction against the associated cam strips 20 or 21. The guiding plates 29 and 30 are also turnable by the throughgoing control foot 19.2 of the sinker 19 for releasing the guiding path 21, against the force of their return spring 33.

It will be understood that each of the elements described above, or two or more together, may also find a useful application in other types of constructions differing from the types described above.

While the invention has been illustrated and described as embodied in a flat knitting machine with needles and sinkers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A two-bed flat knitting machine, comprising needle beds; needles longitudinally displaceable in said needle beds; sinkers rotatably arranged between said needles; a machine carriage actuating said sinkers, said sinkers having a control foot and a projection movable into a comb gap between said needle beds; and means for controlling said sinkers, the controlling means including separate devices which are laterally releasably mountable on said machine carriage and which have a length equal to or less than an effective length of a cam system, said separate devices each have control cam parts for said control foot of said sinker and each of said separate devices selectively associated with each cam system of said machine carriage.

2. A two-bed flat knitting machine as defined in claim 1, wherein each of said separate device has a guiding path for said control foot of said sinker is limited on one side by two coupled cam webs arranged one after the other in a throughgoing direction and positioned and perform adjusting movement opposite to one another and perpendicular to the throughgoing direction of said machine carriage, and at another side by two guiding plates spring-loaded at one side and movable perpendicular to the throughgoing direction.

3. A two-bed flat knitting machine as defined in claim 2; and further comprising a device body; double links articulately connecting said cam webs of said device with said device body in a parallel adjustable manner; and a link coupling said cam webs with one another.

4. A two-bed flat knitting machine as defined in claim 2, wherein said cam webs are arranged so that they are automatically controllable during a carriage stroke reverse by friction forces produced by said needle beds.

5. A two-bed flat knitting machine as defined in claim 2, wherein said cam webs are arranged so that they are automatically controllable during a carriage stroke reverse by friction forces produced by said control foot of said sinker.

6. A two-bed flat knitting machine as defined in claim 2, wherein said cam webs are arranged so that they are automatically controllable during a carriage stroke reverse by friction forces produced by said needle beds and said control foot of said sinker.

7. A two-bed flat knitting machine as defined in claim 2; and further comprising at least one eccentric body which adjusts a maximum adjustment of at least one of said cam webs perpendicular to the throughgoing direction.

8. A two-bed flat knitting machine as defined in claim 2, wherein said cam webs and said guiding plates are provided at their ends with inclines for said control foot of said sinker.

* * * * *